United States Patent [19]

Cutler

[11] Patent Number: 4,501,122

[45] Date of Patent: Feb. 26, 1985

[54] LIQUID PISTON HEAT PUMP

[75] Inventor: Donald R. Cutler, Bolingbrook, Ill.

[73] Assignee: Chicago Bridge & Iron Company, Oak Brook, Ill.

[21] Appl. No.: 526,461

[22] Filed: Aug. 25, 1983

[51] Int. Cl.[3] ..... F25B 1/00

[52] U.S. Cl. ..... 62/116; 62/467; 165/104.21

[58] Field of Search ..... 62/116, 467; 165/104.21

[56] References Cited

U.S. PATENT DOCUMENTS

| | | | |
|---|---|---|---|
| 3,699,779 | 10/1972 | Schlichtig | 62/116 |
| 3,763,663 | 10/1973 | Schlichtig | 62/116 |
| 3,823,573 | 7/1974 | Cassady | 62/467 |
| 4,418,547 | 12/1983 | Clark, Jr. | 62/116 |
| 4,450,690 | 5/1984 | Clark, Jr. | 62/467 |

*Primary Examiner*—Ronald C. Capossela

*Attorney, Agent, or Firm*—Marshall, O'Toole, Gerstein, Murray & Bicknell

[57] ABSTRACT

This disclosure relates to a heat pump including a plurality of interconnected elements, each of said elements comprising a piston body having an evaporator section at one end thereof and a condenser section at the other end thereof, each condenser section being connected to a vapor condenser. Each element has its evaporator section connected by a vapor bridge to the condenser of an adjacent element. Each piston body contains a working fluid having a liquid phase and a vapor phase, the liquid phase forming a liquid piston which oscillates during operation and the pistons of the elements oscillating with a phase displacement. The evaporator sections are located in relatively warm areas and the condensers are located in another cooler area. Portions of the liquid in the evaporator sections vaporize and the vapor is heated, and the heated vapor is condensed in the condensers thereby transferring heat from the warm areas to the cooler areas.

15 Claims, 8 Drawing Figures

LIQUID PISTON HEAT PUMP

This invention relates to apparatus and method for pumping heat from one location to another, and more particularly it relates to a liquid piston Stirling-type heat pump capable of operation without active heating or external pumping power.

BACKGROUND OF THE INVENTION

Various types of heat pumps for transferring heat are well known and have been in common use for many years. Refrigeration and heating systems utilizing motor-driven compressors are common examples of systems for pumping relatively large amounts of heat, but, of course, they require external pumping power. Heat pipes have had more limited use in recent years and have the advantage that they do not require active heating or external pumping power, but they have the disadvantage that their construction requires relatively complex technology.

U.S. Pat. No. 4,148,195 to Gerstmann et al. describes a liquid piston Stirling-type heat pump, and this patent contains a discussion of other prior art in this area. A problem with the heat pump covered by this patent is that it requires active heating by a fuel burner for operation, and the overall construction and operation are relatively complex.

It is a general object of the present invention to provide a passive fluid piston heat pump that is relatively efficient in operation and is relatively uncomplicated in construction.

SUMMARY OF THE INVENTION

A heat pump in accordance with the present invention comprises a plurality of interconnected elements, each of said elements comprising a piston body having an evaporator section at one end thereof and a condenser section at the other end thereof, each condenser section being connected to a vapor condenser. Each element has its evaporator section connected by a vapor bridge to the condenser of an adjacent element. Each piston body contains a working fluid having a liquid phase and a vapor phase, the liquid phase forming a liquid piston which oscillates during operation and the pistons of the elements oscillating with a phase displacement. The evaporator sections are located in a relatively warm area and the condensers are located in another cooler area. Portions of the liquid in the evaporator sections vaporize, and the vapor is condensed in the condensers thereby transferring heat from the warm areas to the cooler areas.

BRIEF DESCRIPTION OF THE DRAWINGS

The foregoing and other objects and advantages of the invention will become more apparent from the following detailed description taken in conjunction with the accompanying figures of the drawings, wherein.

DETAILED DESCRIPTION OF THE DRAWINGS

Figure 1:
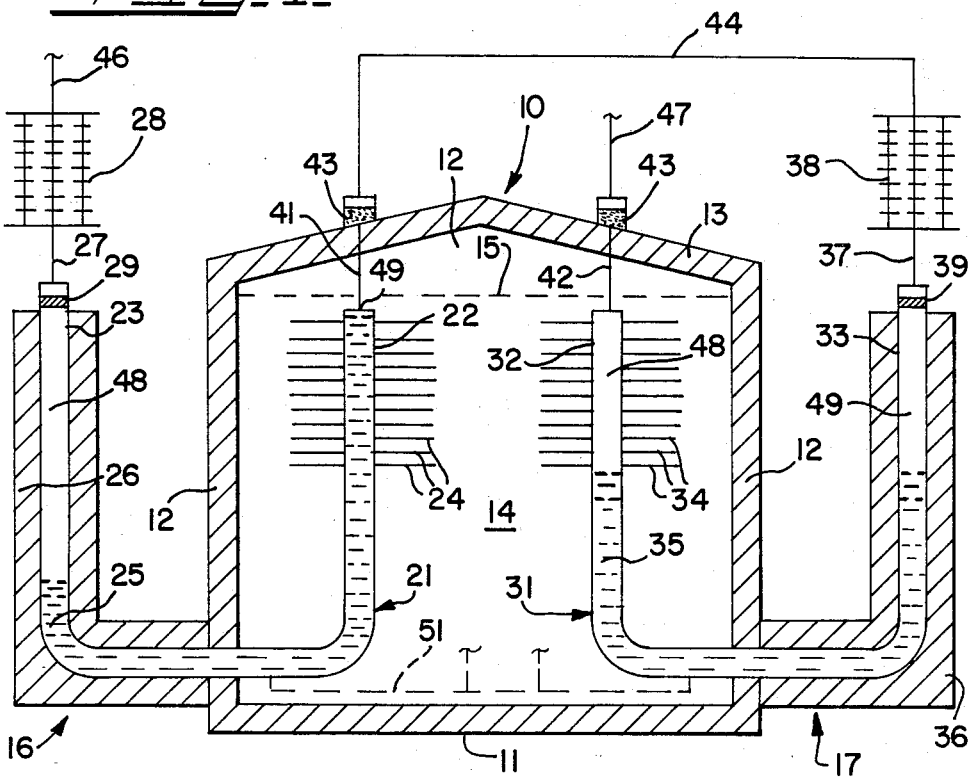
FIG. 1 shows apparatus including a system in accordance with the present invention.

In the specific example illustrated and described herein, a system in accordance with this invention pumps heat from the interior of an enclosure 10 (FIG. 1) to the exterior of the enclosure. The enclosure includes a bottom wall 11, side walls 12 and a top wall 13, which are constructed and interconnected in a conventional manner. As a specific operating example, the enclosure 10 may be filled with water 14 to a level 15, and the function of the system may be to reduce the temperature of the water to below its freezing point and thereby produce ice.

The apparatus comprises a plurality of elements which are interconnected to form a complete heat pump system. While an operable system may contain 2, 3, 4, etc. elements, the specific example illustrated and described herein contains four elements 16, 17, 18 and 19 shown in FIGS. 5 to 8. FIG. 1 illustrates only two of the elements 16 and 17 but it should be understood that all of the elements are essentially identical and similarly interconnected.

The element 16 includes a piston body 21 in the form of a U-shaped tube, having an evaporator section 22 mounted within the enclosure 10 and a condenser section 23 that is outside the enclosure. Within the body 21 is a liquid piston 25 formed by a working fluid. The evaporator section 22 has a plurality of heat transfer fins 24 fastened to the outside of the tubular body 21, which are submerged in the water 14. The portion of the body 21 which is outside the enclosure 10 is substantially covered with a heat insulation jacket 26. The upper end of the section 23 is connected by a pipe 27 to a condenser 28, and a thermal isolation block 29 is connected between the pipe 27 and the section 23. Thus, while the section 23 is outside the enclosure 13, the jacket 26 and the block 29 insulate the section 23 from the ambient environment.

The element 17 similarly includes parts 31–39 that correspond in construction and function to the parts 21–29 of the element 16.

The upper ends of the evaporator sections 22 and 32 are respectively connected to pipes 41 and 42 which extend through the wall 13. Thermal isolation blocks 43 are connected in the pipes 41 and 42 so that the evaporator sections 22 and 32 are also insulated from the outside environment. A vapor pipe 44 connects the pipe 41 with the upper or feed end of the condenser 38 of the element 17, and similar pipes 46 and 47 respectively connect the condenser 28 to the element 19 and the pipe 42 to the element 18. In each instance, the vapor pipe connects the upper end of the condenser of one element to the evaporator section of the next adjacent element, and the lower or drain end of each condenser is connected to enable condensed liquid to drain into the upper end of the associated condenser section.

As mentioned, the piston bodies of the elements are partially filled with liquid pistons 25 and 35. The pistons may, for example, comprise liquid Freon 22, and the spaces or volumes 48 and 49 in each body above the ends of the piston are filled with Freon vapor. In this example, approximately 80% of the volume of each piston body is filled by the liquid piston.

With reference to FIGS. 6–9, assume an initial condition where all of the piston bodies have been filled with equal amounts of liquid, and where the liquid pistons for all of the elements are in the initial or static position shown for the piston 35 of the element 17. Assume further that the temperature around all of the evaporator fins 24 and 34 is higher than the temperature around the condensers 28 and 38. This may occur, for example, during the winter in northern climates.

Figure 5:
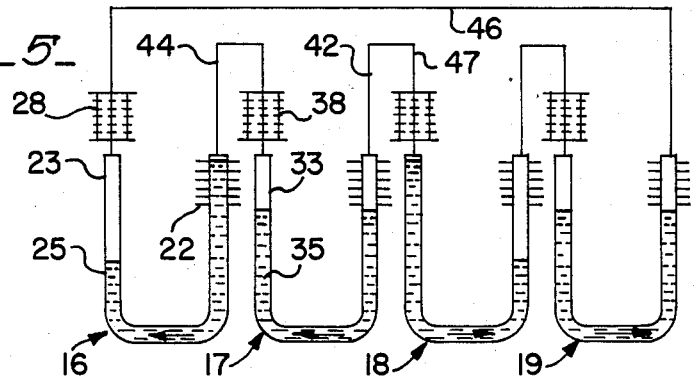
FIGS. 5, 6, 7 and 8 are schematic diagrams illustrating a time-sequence of operation.
Figure 6:
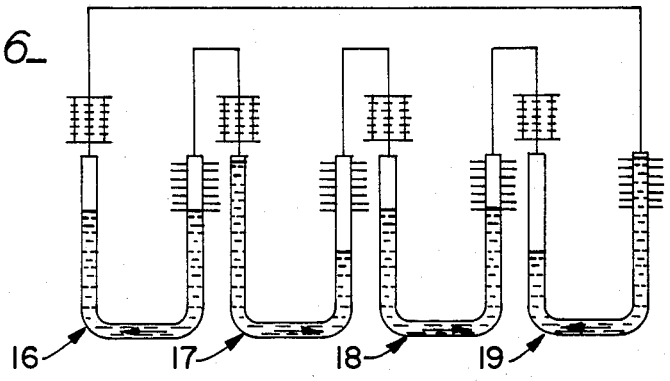
Figure 7:
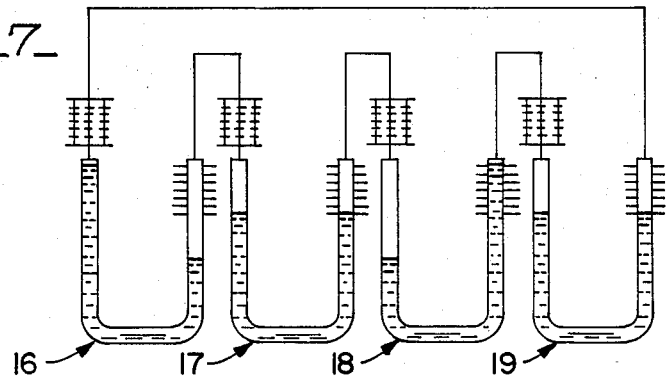
Figure 8:
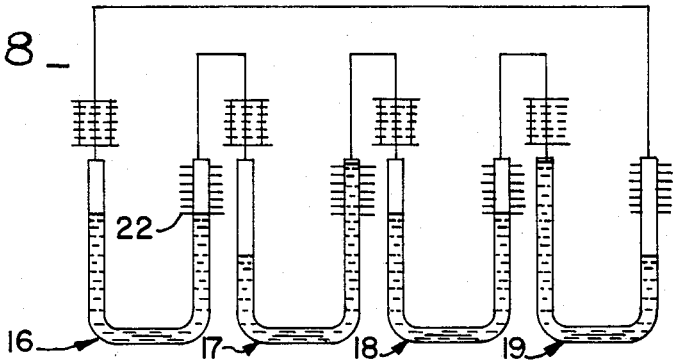

When the temperature difference between the evaporators and the condensers reaches a certain value, the system becomes unstable and the liquid pistons are self-actuated into oscillations. Further, there is a phase displacement of 90° (in the instance where the system includes four elements) between the positions of the pistons of adjacent elements. This is illustrated by FIG. 5 where the liquid piston 25 of the element 16 fills the evaporator section 22 and the piston has started to move into the intermediate level of the section 23; the piston 35 in the element 17 is at an intermediate level in the two sections and is moving further into the condenser section; the piston in the element 18 fills the condenser section and is starting to move into the intermediate level; and the piston in the element 19 is at an intermediate level in the two sections and is moving further into the evaporator section. The piston of each element reciprocates between the two sections, as shown by FIGS. 5–8, which illustrates the positions of the four pistons at four successive time intervals in a complete cycle of oscillation, and the 90° phase displacement of the pistons of adjacent elements is maintained during these oscillations.

The portion of the working fluid in the evaporator section of each element absorbs heat from the piston body and the fins and thus cools the surrounding water. The working fluid is preferably selected so that its boiling point, at the pressure within the system, of the fluid is below the temperature range expected to be encountered during operation of the system. Consequently the absorbed heat in the evaporator section causes part of the liquid to boil into vapor and the vapor to expand. The heated vapor creates a pressure wave which causes the pistons to oscillate. The oscillating movements of the pistons causes the vapor to be moved from the evaporator section of one element to the condenser of the next adjacent element. For example, the movement of the piston 25 from the position shown in FIG. 8, to the position of FIG. 5 and then to the position of FIG. 6 causes the vapor in the evaporator 22 to be moved to the condenser 38. The condensers are at a cooler temperature and consequently the vapor condenses and moves into the condenser section 33 of the element 17. The four elements 16–19, of course, operate in a similar cyclical manner to pump heat from the interior area of the enclosure 10 to the exterior area.

Figure 4:
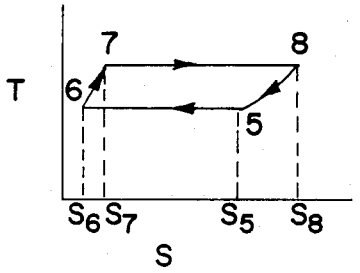
FIGS. 2, 3 and 4 show diagrams illustrating the operation of the system.
Figure 2:
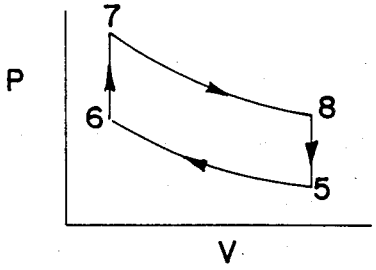
Figure 3:
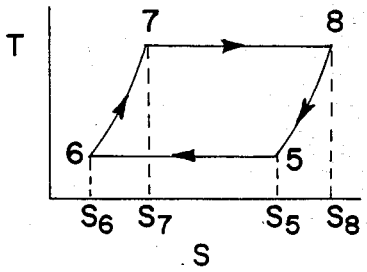

FIGS. 2, 3 and 4 show diagrams which further illustrate the operation of the system. These figures illustrate the state of the volume of vapor in the condenser section 23 and the condenser 28 and in the evaporator of the element 19. The numbers at the corners of each diagram relate the states at these points to FIGS. 5, 6, 7 and 8. FIG. 2 is a pressure-volume diagram and FIG. 3 is a temperature-entropy diagram for idealized conditions and are similar to diagrams for a Stirling cycle engine. FIG. 4 shows the actual temperature-entropy diagram for this volume of vapor.

In FIG. 5 (state 5 in FIGS. 2–4), this vapor is at a maximum volume and a minimum temperature. As the pistons advance to FIG. 6, this volume is compressed to a minimum and the temperature remains constant. It is between these two states that heat is rejected by the system in the condenser 28. As the pistons advance to FIG. 7, this volume remains constant and the temperature rises to a maximum value, and the majority of the vapor has now been transferred to the evaporator section of element 16. As this vapor advances to FIG. 8, heat is absorbed through the evaporator at a constant temperature and expands to a maximum volume. At the state of FIG. 6, the vapor has been transferred at a constant volume from the evaporator of element 19 to the condenser section of element 16. Because of the temperature drop in the evaporator, the vapor pressure drops to a minimum for the cycle.

As mentioned above, the foregoing description relates to idealized conditions and is similar to that of a Stirling cycle engine. An efficient Stirling cycle of this nature would include regenerators in the vapor pipes, such as pipe 46, connecting the evaporator sections with the condensers 28. A 100% effective regenerator would give up an equal amount of heat between states 6 and 7 as is stored between states 8 and 5, and mathematically, $S_8-S_5=S_7-S_6$.

The actual temperature-entropy diagram for a system according to this invention is shown in FIG. 4 and two significant differences from FIG. 3 are apparent. First, because of imperfect regeneration $S_8-S_5\neq S_7-S_6$; and secondly, the temperature difference between the maximum and minimum values is less. The area in the T-S envelope represents the heat energy required to drive the pistons and produce work. For the present system which pumps heat, it is more desirable to keep this area as small as possible. Conversely, a well designed Stirling engine, which produces usable work, should have a large envelope.

During the operation of the system as described above, it is possible for an imbalance of liquid levels to develop if the heat flux through one element is greater or less than through the other elements. Such an imbalance may be prevented by connecting a small diameter capillary tube between the elements as indicated by the lines 51 in FIG. 1, which would maintain the liquid levels at an equilibrium. Slight differences in liquid levels between elements may change the phase relation between elements by a small amount, but would have little effect on the overall system. The period of oscillation of the pistons of the system is a function of the piston length and the pressure in the system.

In the specific example described wherein the system is installed to freeze water in the enclosure 10 during the cold winter months and to recover the stored refrigeration during the warm summer months, the insulation 26 and the blocks 29, 39 and 43 are necessary to prevent reversal of operation of the system in the event there is a temporary reversal of the temperature levels within and without the enclosure. As mentioned previously, the foregoing description assumes that the higher temperature level is within the enclosure. The condensing sections 23, 33 etc. could also be placed within the enclosure 10 so long as these sections are insulated and the condensers 28, 38 etc. are outside in the colder environment.

In the specific example being described, the total volume of the system should be evacuated to one or two inches of mercury. Freon 22 vapor at a temperature of about 70° F., is placed in the system to increase the pressure to about 137.2 psia. Equal volumes of liquid Freon 22 are then pumped into the elements to form the liquid pistons, and in each element the liquid piston comprises approximately 80% of the total volume of the element.

Working fluid other than Freon 22 may also be used. For example, in operation at very low temperatures, liquid helium may be suitable, whereas at high temperatures molten salts or metals may be used.

As previously mentioned, systems having other than four elements may be provided. In each system, the phase displacement between the pistons would be 360°/N where N is the number of elements.

It should be apparent that a novel and useful heat pump has been provided. The pump has a relatively simple construction and it operates to transfer heat relatively quickly from one area to another, without the requirement of an active or direct fired energy supply. By this it is meant that a burner or motor-driven compresser is not required. The system may be used to pump heat wherever a temperature difference exists, and it is self-actuated into operation whenever the temperature difference is reached. Other examples of use are for rapid heating of passenger compartments of motor vehicles from the hot engine exhaust, and geothermal and solar heat transfer.

A nitrogen precharge may be desirable when you wish to control the temperature difference at which the system operates. The nitrogen precharge increases the temperature difference required before the system starts to operate.

What is claimed:

1. A heat pump system comprising:

(a) a plurality of adjacent substantially similar piston bodies, each body having an evaporator end section and a condenser end section;

(b) a working fluid in each of said piston bodies and said fluid being the same in all of said piston bodies, said fluid forming a liquid piston and a vapor above said piston;

(c) a condenser associated with each piston bodies, each of paid condensers having a drain end connected to said condenser end section of the associated piston body, and (d) a plurality of vapor pipes, one of said pipes connecting said feed end of each condenser to said evaporator end of an adjacent piston body, there being a free flow of said vapor through said vapor pipes from said evaporator end section of each body to said feed end of the associated condenser and said vapor pipes being substantially devoid of regenerators; and, (e) said evaporator end section of each body being adapted to be located in a relatively warm first area and said condensers being adapted to be located in a relatively cooler second area, and said pistons being adapted to oscillate because of the temperature difference between said first and second areas.

2. A heat pump system according to claim 1, and further including insulation covering said condenser end sections.

3. A heat pump system according to claim 1, and further including heat blocks connected between said vapor pipes and said evaporator and condenser end sections.

4. A heat pump system according to claim 1, and further including a plurality of heat exchanger fins connected to said piston bodies in said evaporator end sections.

5. A heat pump system according to claim 1, and further including capillary tubes interconnecting said piston bodies.

6. A heat pump system according to claim 1, wherein said pistons oscillate with a phase displacement of 360°/N between adjacent bodies, where N is the number of said bodies.

7. A heat pump system according to claim 6, wherein four of said bodies are provided and said displacement is 90°.

8. A heat pump system according to claim 1, wherein said working fluid is Freon 22, and each liquid piston fills approximately 80% of the volume of the associated body.

9. Apparatus comprising:

(a) an enclosure forming an interior area that is substantially separated from the exterior area, the interior area being adapted to have a temperature difference with said exterior area;

(b) a plurality of adjacent substantially similar piston bodies, each body having an evaporator end section and a condenser end section;

(c) a working fluid in each of said piston bodies and said fluid being the same in each of said piston bodies, said fluid forming a liquid piston and a vapor above said piston;

(d) a condenser associated with each of said piston bodies, each of said condensers having a drain end connected to said condenser end section of the associated piston body, and having a feed end;

(e) a plurality of vapor pipes, one of said pipes connecting said feed end of each condenser to said evaporator end of an adjacent piston body, there being a free flow of said vapor through said vapor pipes from said evaporator end section of each body to said feed end of the associated condenser; and (f) said evaporator end section of each body being adapted to be located in one of said areas and said condensers being adapted to be located in the other of said areas, and said pistons being adapted to oscillate because of said temperature difference between said areas.

10. Apparatus according to claim 9, wherein said evaporator end section is in said interior area, and said interior area is adapted to have a higher temperature than said exterior area.

11. Apparatus according to claim 10, wherein four of said piston bodies are provided.

12. Apparatus according to claim 10, wherein said working fluid is Freon 22.

13. Apparatus according to claim 9, and further including insulation covering said condenser end section, and heat blocks connected between said vapor pipes and said evaporator and condenser end sections.

14. Apparatus according to claim 9, wherein said heat pipes are devoid of regenerators.

15. In a method of pumping heat from a relatively warm area to a relatively cool area utilizing a plurality of substantially similar piston bodies, each body having an evaporator section and a condenser section, comprising the steps of locating the evaporator sections in the warm area, connecting a condenser between the condenser section of each body and the evaporator section of an adjacent body, confining a similar working fluid in each of said bodies, said fluid having a liquid state forming a liquid piston in each body and a vapor state above the piston, the pistons oscillating because of the temperature difference between said areas, and said oscillations reversibly transferring vapor between said evaporator sections and said condensers and thereby pumping heat without regeneration.

* * * * *

UNITED STATES PATENT AND TRADEMARK OFFICE

CERTIFICATE OF CORRECTION

PATENT NO. : 4,501,122

DATED : February 26, 1985

INVENTOR(S) : Donald R. Cutler

It is certified that error appears in the above-identified patent and that said Letters Patent is hereby corrected as shown below:

In Claim 1, that portion reading:

"(c) a condenser associated with each piston bodies, each of paid condensers having a drain end connected to said condenser end section of the associated piston body, and"

should read:

--(c) a condenser associated with each of said piston bodies, each of said condensers having a drain end connected to said condenser end section of the associated piston body, and having a feed end;--

Signed and Sealed this

*Eighteenth* Day of *June 1985*

[SEAL]

*Attest:*

DONALD J. QUIGG

*Attesting Officer*

*Acting Commissioner of Patents and Trademarks*